United States Patent [19]

Yamamoto et al.

[11] Patent Number: 4,988,222

[45] Date of Patent: Jan. 29, 1991

[54] DOUBLE PRINT HEAD

[75] Inventors: Tetsuya Yamamoto; Takashi Moriya; Yoshimasa Tai, all of Tanashi, Japan

[73] Assignee: Citizen Watch Co., Ltd., Tokyo, Japan

[21] Appl. No.: 288,250

[22] Filed: Dec. 22, 1988

[30] Foreign Application Priority Data

Dec. 23, 1987 [JP] Japan ..... 62-195062

[51] Int. Cl.[5] ..... B41J 2/505

[52] U.S. Cl. ..... 400/124; 101/93.05

[58] Field of Search ..... 400/121, 124, 157.2; 101/93.04, 93.05

[56] References Cited

U.S. PATENT DOCUMENTS 4,225,250 9/1980 Wagner ..... 400/124

4,279,521 7/1981 Kightlinger ..... 400/124

4,669,898 6/1987 Yeh ..... 400/124

*Primary Examiner*—Edgar S. Burr

*Assistant Examiner*—Ren Yan

*Attorney, Agent, or Firm*—Birch, Stewart, Kolasch & Birch

[57] ABSTRACT

A dot matrix double print head including a front actuator and a rear actuator is disclosed. Each actuators has a print wire unit in which a plurality of print wires are slidably mounted, a plurality of electromagnets, and a plurality of armatures corresponding to the number of electromagnets. The length of the armature of the rear actuator is smaller than that of the front actuator, and thereby the moments of inertia of each of the armatures and print wires of both the actuators approach each other.

4 Claims, 3 Drawing Sheets

DOUBLE PRINT HEAD

BACKGROUND OF THE INVENTION

The present invention relates to a print head for a dot matrix printer having a plurality of print wires, and more particularly to a double print head in which a pair of print heads are disposed in the axial direction.

In order to increase the number of the print wires and to increase printing speed, a double print head is used. In the double print head, each print wire provided in a rear actuator is inevitably longer than that utilized in a front actuator. Accordingly, the moment of inertia of each moving element of the rear actuator becomes larger than that of the front actuator. Thus, the actions of the moving elements of the rear actuator are different from the actions in the elements in the front actuator. These differences which reduce the quality of the print. Namely, if materials of the print wires and armatures, the shapes of the armatures, and the diameters of the print wires and other elements of the front and rear actuators are the same. The impact force of the print wire of the front actuator, which has a short length, becomes larger than that of the rear actuator. Thus, uniform quality of the print cannot be obtained. Therefore, it is the object of the present invention to solve this technical problem thereby equalizing the actions of the print wires of both actuators.

In order to solve this problem, two methods are known. A first method is to change the electrical driving conditions in both actuators, and a second method is to change the materials of the print wires in both actuators (Japanese Patent Application Laid-open 59-95164).

However, such methods have produced further problems. The former method renders the driving circuit complicated. In the latter method, abrasion resistances of respective print wires are different from each other which makes the tone of the print irregular with time.

SUMMARY OF THE INVENTION

The object of the present invention is to provide a double print head which can reduce the difference in the actions in the printing operation and the differences in of abrasions between print wires in the front actuator and the rear actuator.

According to the present invention, there is provided a dot matrix double print head including a front actuator and a rear actuator, each actuator having a print wire unit in which a plurality of print wires are slidably mounted, a plurality of electromagnets, a plurality of armatures corresponding to the electromagnets. The armatures of both of the actuators are different in shape so that the moments of inertia of each of the armatures and the print wires of both of the actuators approach to each other.

In one aspect of the present invention, the print wires of both the of actuators are made of the same material, and the armatures of both the actuators are also made of the same material.

In another aspect of the present invention, the length of the armature of the rear actuator is smaller than that of the front actuator.

Other objects and features of the present invention will become more apparent from the following description with reference to the accompanying drawings.

BRIEF DESCRIPTION OF DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
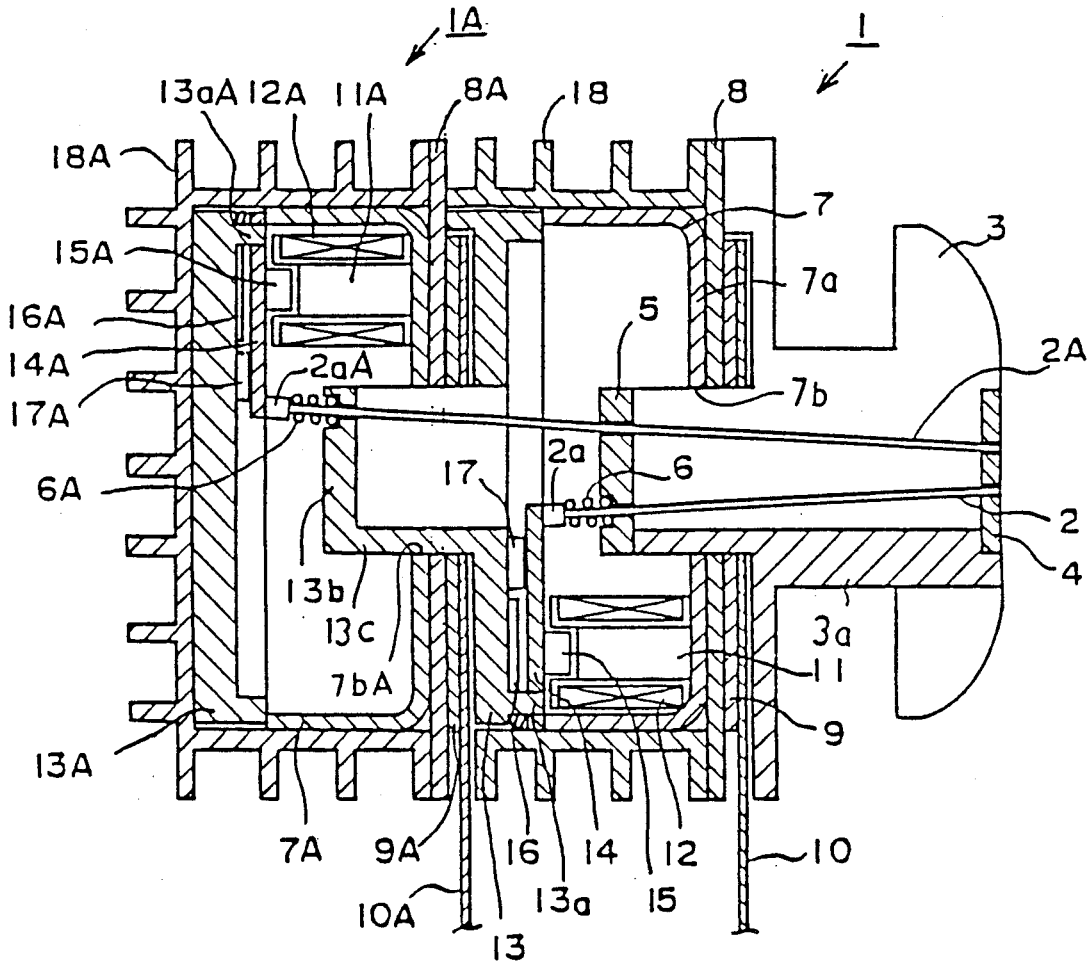
FIG. 1 is a sectional view showing a double print head for a dot matrix printer according to the present invention.

Referring to FIG. 1, a double print head according to the present invention comprises a front actuator 1 and a rear actuator 1A secured to the front actuator 1. Since the construction of the rear actuator 1A is similar to the front actuator 1, the same parts of the rear actuator 1A as those of the front actuator 1 are identified with the same reference numerals with A, for simplifying the descriptions thereof.

The front actuator 1 comprises a print wire guide nose 3 provided with a front end guide plate 4 and an intermediate guide plate 5. A plurality of print wires 2 are slidably supported in the guide plates 4 and 5. A compression coil return spring 6 is disposed between an impact head 2*a* of each print wire 2 and the intermediate guide plate 5. Thus, the print wire 2 is biased to the rear portion of the actuator 1.

A cylindrical yoke 7 having a base plate 7*a* is disposed adjacent the print wire guide nose 3, with the interposition of a heat conductor 8, an insulator 9, and a flexible printed wiring board 10. The base plate 7*a* has a central opening 7*b* for receiving a rear portion of the print wire guide nose 3. On the base plate 7*a*, a plurality of cores 11 are circularly disposed and secured to the base plate. A coil bobbin 12 having a coil is attached to each core 11 to form an electromagnet.

An armature base 13 having a plurality of projections 13*a* is secured to the yoke 7. A plurality of radially arranged armatures 14, each corresponding to the core 11, are provided for impacting the print wires 2. Each armature 14 has a hole at a base end which is engaged with the projection 13*a* of the base 13 so as to be pivoted in the axial direction of the core 11. Secured to the armature 14 is a plunger 15 which is inserted into the bobbin 12, corresponding to the core 11. An armature spring 16 is disposed between the base 13 and a base end of the armature 14 to urge the end to the yoke 7. An actuating end of the armature 14 is urged by the return spring 6 to a stopper 17 secured to the base 13.

The base 13 has a projected nose portion 13*c* formed as a print wire guide nose for print wires 2A of the rear actuator 1A. The nose portion 13*c* is engaged with a central opening 7*b*A of the yoke 7A of the rear actuator 1A. The nose 13*c* is provided with a guide plate 13*b* at the rear end thereof. Each of the print wires 2A is slidably supported in the guide plate 13*b* and the guide plates 4 and 5 of the front print head 1. Print wires 2 and 2A are alternately and annularly arranged in the guide plate 5, and disposed in the guide plate 4 so as to form two columns. The base 13 is secured to the yoke 7A, interposing a heat conductor 8A, insulator 9A and printed wiring board 10A.

A cylindrical heat sink 18 is provided for covering the yoke 7 and the armature base 13 together. A cylindrical heat sink 18A having a base plate covers the yoke 7A and the base 13A. The heat sink 18A of the rear actuator 1A, the heat sink 18 and the nose 3 of the front actuator 1 are secured to each other by clamp means (not shown).

In order to equalize the moment of inertia of moving elements of the rear actuator 1A to that of the front actuator 1, it is desirable to reduce the moment of inertia of the rear actuator to the moment of inertia of the front actuator 1. There are some ways for reducing the moment of inertia. An effective method is to change the length of the armature. Since the print wire 2A in the rear actuator 1A is long, a contact point of the print wire head 2*a*A of the print wire 2A to the armature 14A can be positoned close to the fulcrum of the armature 14A. Accordingly, the length of the armature 14A in the rear actuator 1A can be reduced to equalize the moment of inertia to that of the armature 14 in the front actuator 1, as described hereinafter.

Materials of print wires 2 and 2A are the same and the materials of the armatures 14 and 14A are also the same.

Figure 2A:
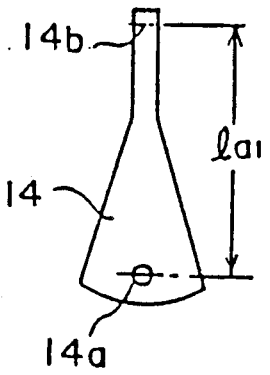
FIGS. 2*a* and 2*b* are plan views showing armatures provided in the print head of FIG. 1.
Figure 2B:
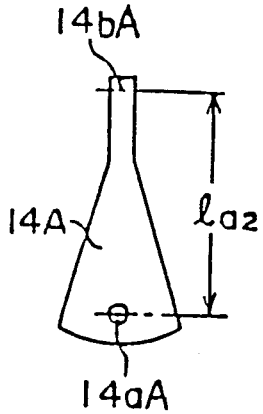
Figure 3A:
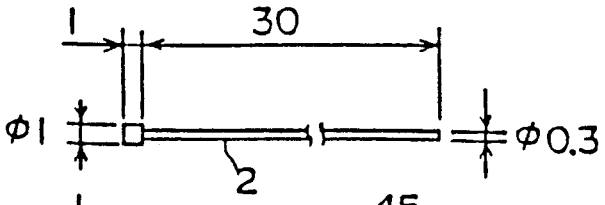
FIGS. 3*a* and 3*b* are side views showing print wires in the print head.
Figure 3B:
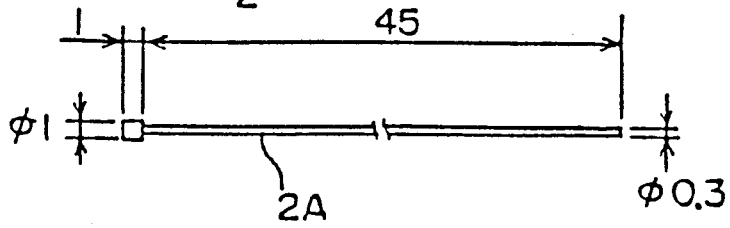
Figure 4A:
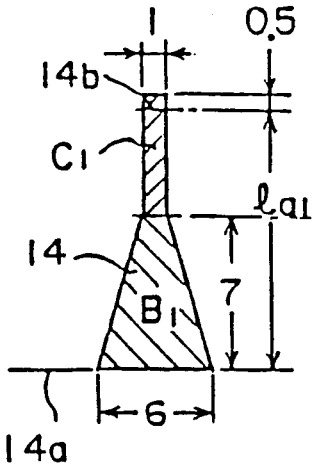
FIGS. 4*a* and 4*b* are explanatory views showing the armatures.
Figure 4B:
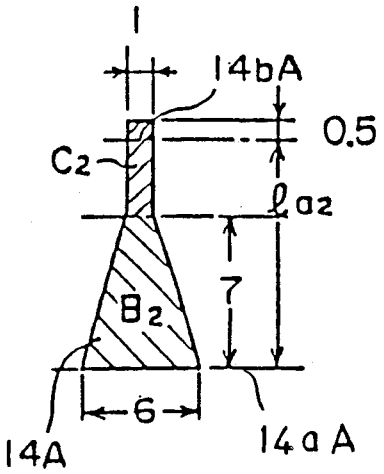

Referring to FIGS. 2*a* and 2*b*, the armature 14 has the length $la_1$ between a central point of a fulcrum 14*a* and a contact point 14*b* with the print wire head 2*a*. The armature 14A has the length $la_2$ between a central point 14*a*A and a contact point 14*b*A. The length $la_2$ is determined to be a smaller value than the length $la_1$, so that the combined moment of inertia of print wire 2A and armature 14A of the rear actuator 1A may be equalized to that of the moving elements in the front actuator 1.

Actual moments of inertia are calculated as follows. Print wires 2 and 2A and armatures 14 and 14A are made of iron having density of $7.9\times10^{-3}$ g/mm$^3$. Dimensions of print wires 2 and 2A and armatures 14 and 14A are respectively determined as shown in FIGS. 3*a*, 3*b*, 4*a* and 4*b*. The unit of the dimensions is millimeter. The thickness of the armatures 14 and 14A is 1 mm.

The moment of inertia $I_1$ of the front actuator 1 is represented as follows.

$$\begin{aligned} I_1 &= I_{B1} + I_{C1} + I_{N1} \\ &= 2.03 \text{ g mm}^2 + I_{B1} + m_1\, la_1^2 \end{aligned}$$

where $I_{B1}$ is the moment of inertia of a base portion $B_1$ of the armature 14, $I_{C1}$ is the moment of inertia of an arm portion $C_1$, $I_{N1}$ is the moment of inertia of the print wire 2, and $m_1$ is the mass of the print wire 2. The mass $m_1$ is $m_1=2\times10^{-2}$ g.

Similarly, the moment of inertia $I_2$ of the rear actuator 1A is represented as follows.

$$\begin{aligned} I_2 &= I_{B2} + I_{C2} + I_{N2} \\ &= 2.03 \text{ g mm}^2 + I_{C2} + m_2\, la_2^2 \end{aligned}$$

where $I_{B2}$ is the moment of inertia of a base portion $B_2$ of the armature 14A, $I_{C2}$ is the moment of inertia of an arm portion $C_2$, $I_{N2}$ is the moment of inertia of the print wire 2A, and $m_2$ is the mass of the print wire 2A. The mass $m_2$ is $m_2=3.133\times10^{-2}$ g.

$$\begin{aligned} I_1 &= 2.03 + 2.15 + 2.30 \\ &= 6.48 \text{ g mm}^2 \end{aligned}$$

If the length $la_2$ is 9.4 mm, $I_2$ is $$I_2=6.45 \text{ g mm}^2$$

Thus, the moment of inertia $I_2$ may be approximately equalized to the moment of inertia $I_1$.

Figure 5A:
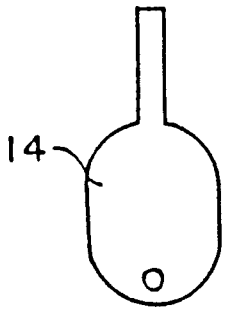
FIGS. 5*a*, 5*b*, 6*a* and 6*b* are plan views showing modifications of the armatures.
Figure 5B:
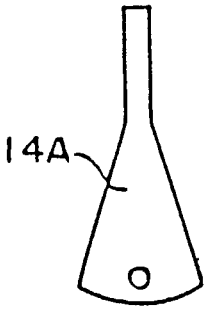

FIGS. 5*a* and 5*b* show a modification of the armatures. The armatures 14 and 14A are different from each other in width. The base portion of the armature 14A is made narrower than that of the armature 14, so that the moment of inertia of the elements of the rear actuator may approach that of the front actuator.

Figure 6A:
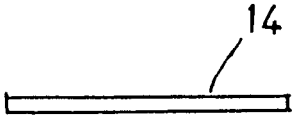
Figure 6B:
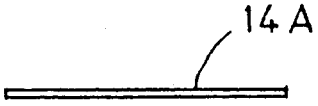

Further, armatures may be changed in thickness, as shown in FIGS. 6*a* and 6*b*. For example, if the thickness of the armature 14 is 0.8 mm, the thickness of the armature 14A becomes 0.7 mm.

In accordance with the present invention, the armatures of the front actuator and the rear actuator are made different from each other in shape, so that the moments of inertia of moving elements of both actuators may be equalized. Thus, it is unnecessary to provide a special driving circuit, and the difference of actions and abrasions between print wires of front and rear actuators can be reduced.

While the invention has been described in conjunction with preferred specific embodiments thereof, it will be understood that this description is intended to illustrate and not limit the scope of the invention, which is defined by the following claims.

What is claimed is:

1. In a dot matrix double print head for a dot matrix printer including a front actuator and a rear actuator, each actuator having:

a print wire unit in which a plurality of print wires are slidably mounted, the print wires associated with the front actuator being shorter than the print wires associated with the rear actuator;

a plurality of electromagnets; and a plurality of armatures operatively associated with the electromagnets so as to actuate corresponding wires;

and means for providing substantially equal moments of inertia for each of the armatures and their associated print wires of both of the actuators, said means including making the armatures of the rear actuator of a shorter length than the armatures of the front actuator so that each long print wire is actuated by a short armature and each short print wire is actuated by a long armature.

2. The double print head according to claim 1 wherein the print wires of both the actuators are made of the same material, and the armatures of both the actuators are also made of the same material.

3. The double print head according to claim 1 wherein the width of the armature of the rear actuator is smaller than that of the front actuator.

4. The double print head according to claim 1 wherein the thickness of the armature of the rear actuator is less than that of the front actuator.

* * * * *